United States Patent [19]

Ely, Jr.

[11] Patent Number: 4,919,380

[45] Date of Patent: Apr. 24, 1990

[54] ROTATIONALLY AND TRANSLATIONALLY PIVOTABLE BALANCING ASSEMBLY

[75] Inventor: Ralph L. Ely, Jr., Durham, N.C.

[73] Assignee: Kelyx, Inc., Durham, N.C.

[21] Appl. No.: 324,251

[22] Filed: Mar. 15, 1989

[51] Int. Cl.[5] ..... A47K 1/08

[52] U.S. Cl. ..... 248/311.2; 248/364

[58] Field of Search ..... 248/123.1, 205.1, 364, 248/311.2; 362/410, 401, 413, 414, 431, 311

[56] References Cited

U.S. PATENT DOCUMENTS

| | | | |
|---|---|---|---|
| D. 226,623 | 4/1973 | Shuford | 248/311.2 |
| 1,989,974 | 2/1935 | Elias | 248/205.1 |
| 2,291,686 | 8/1942 | Bray | 248/364 X |
| 3,077,537 | 2/1963 | Squier | 362/401 |
| 4,028,543 | 6/1977 | Oster | 362/401 |
| 4,210,302 | 7/1980 | Serkez | 248/205.1 X |

FOREIGN PATENT DOCUMENTS

| | | | |
|---|---|---|---|
| 270678 | 12/1950 | Switzerland | 248/364 |

*Primary Examiner*—J. Franklin Foss

*Attorney, Agent, or Firm*—Olive & Olive

[57] ABSTRACT

A rotationally and translationally pivotable balancing structure is disclosed, which may comprise a variety of functional elements, such as beverage container holders, lamps, racks, dispensers, and the like. The balancing structure comprises an elongate member on portions of which are mounted a functional element and a counterweight, in spaced relationship to one another. Associated with the balancing member is a pivot structure comprising (i) an omnidirectional fulcrum having a base structure reposable on a support surface, such as a tabletop or arm chair top surface, for areal contact therewith, and (ii) a support arm joined to the elongate member and mounted on the omnidirectional fulcrum, to permit rotational and translational pivotable movement of the elongate member relative to the support surface on which the omnidirectional fulcrum is disposed. In one embodiment, the balancing structure comprises a beverage container holder, which may be employed with a lawn chair, rocking chair, or other seating article, to accommodate movement of the beverage container holder without spillage of liquid therefrom.

6 Claims, 1 Drawing Sheet

ROTATIONALLY AND TRANSLATIONALLY PIVOTABLE BALANCING ASSEMBLY

BACKGROUND OF THE INVENTION

1. Field of the Invention

This invention relates to a rotationally and translationally pivotable balancing assembly, constituting, in specific embodiments, articles such as lamps, drink holders, and the like, which may be reposed on support surfaces such as table-tops, desk-tops, arm top surfaces of arm chairs, etc.

2. Description of the Related Art

In the use of end tables, desks, night stands, coffee tables, and similar furniture items, the surface areas provided on top surfaces thereof are generally quite limited.

For example, when lamps are reposed on such top surfaces, the remaining useful surface areas are often inadequate for desired purposes for which such furniture items are otherwise employed.

In recognition of this shortcoming, various lighting fixtures have been devised which utilize a bracket which clamps over the edge of a table-top, desk-top, or the like, the bracket being retained in place by a mounting screw which may be selectively manually tightened against the edge portion of the furniture item, with the bracket being adapted to support a lamp or other light fixture coupled thereto, typically by means of an associated frame.

The frame may be articulated, comprising serially-connected sections which are associated with springs or other tensioning means to maintain the light fixture on the end of the frame at a desired spatial position. Alternatively, the frame may comprise a goose-neck structure which serves the same purpose. Numerous other configurations of frames are employed in lamps assemblies of such type, as associated with bracket means for table-edge mounting of the lamp assembly.

A common deficiency associated with the above-described type of lamp structure is that the mounting bracket engaging the furniture top surface has tendency to mar or otherwise damage the top surface as well as the associated edge region of the furniture item to which it is attached. Thus, the manual tightening which must be effected to securely attach the mounting bracket to the edge region of the furniture item frequently results in dents or gouges in the furniture top surface, particularly when such furniture top surface is formed of a soft material such as wood.

It would therefore be a significant advance in the art to provide a lamp assembly which is supportable on an edge region of a furniture top surface, but which is devoid of any compressively attached mounting brackets, clamps, or the like, which may damage or mar the furniture item.

Another disadvantage associated with the use of tables of various types, desks, and counters, is that their top surfaces frequently are susceptible to damage resulting from condensation of moisture on the outside of liquid containers which are placed on such surfaces and which contain liquid at a temperature below the ambient air temperature.

This "sweating" phenomenon may result in water-spotting, staining, or other discoloration of wood support surfaces, and corrosion of metal surfaces.

Accordingly, it has become a common usage to employ coasters to support containers of cold liquids, to avoid contact of condensate with the top surface of the furniture or counter. Nonetheless, in many instances, coasters may not be available, and the liquid consumer is forced to employ substitutes for such coasters, e.g., newspapers, magazines, and the like, which are unsatisfactory in that they are liquid permeable, so that the condensated liquid may nontheless reach the support surface which is desired to be protected therefrom.

Accordingly, it would be a significant advance to provide a holder for cold liquid containers which does not adversely affect the aesthetic appearance of a furniture top surface when such surface is employed to support a container of cold liquid in the course of consumption of the liquid therein.

In addition to the foregoing, arm chairs of various types are in use, including chairs in which the user may selectively adjust his or her position. Examples include lawn chairs, chaise lounges, recliners, etc., as well as arm chairs such as swivel chairs, rocking chairs, and the like, in which adjustment of the seated user's position likewise alters the orientation of the arms of the chair.

When chairs of such type e.g., lawn chairs and chaises, are used for leisure or recreation purposes, beverages are often consumed by the seated user of the chair. In order to free the hands of the seated person for other activities, such as knitting, playing cards, reading, and the like, it would be highly advantageous to provide a means for holding a liquid container, such as a drinking glass or can of beverage, which accommodates a change in orientation of the chair and its arms during usage of the chair, without spillage of liquid, and which is easily moved from place to place.

It therefore is an object of the present invention to provide a structure which variously accommodates the foregoing needs, and which may in specific embodiments be configured as a lamp or lighting fixture, beverage container holder, or the like.

Relative to the rotationally and translationally pivotable assembly of the present invention, related art includes various so-called "kinetic sculptures" in which a figure or sculptural body is provided with a base portion having the shape of a downwardly converging cone which at its lower point is reposed on a pedestal, the figure or other sculptural body itself being configured with laterally extended arms or similar elements having counter-weights at their outer extremities.

Such kinetic sculpture may for example take the form of an aerial bicyclist carrying a balancing pole with balance weights at its respective extremities, such figure being pivotally balanced on the lower conical portion thereof so as to accommodate free rotation or lateral displacement of the figure from a normal upright position, with the lower conical projection of the figure reposing on the pedestal base of the kinetic sculpture.

SUMMARY OF THE INVENTION

In a broad aspect, the present invention relates to a rotationally and translationally pivotable assembly, comprising:

an elongate member, which may for example be generally vertically aligned;

a functional element mounted on the elongate member, e.g., an upper part thereof when the elongate member is generally vertically aligned;

a counter-weight mounted on the elongate member in spaced relationship to the functional element, e.g., on a lower portion of the elongate member when the elongate member is generally vertically aligned; and a pivot structure comprising (i) an omnidirectional fulcrum with a base structure reposable on a support surface for areal contact therewith, and (ii) a support arm joined to the elongate member and operatively associated with the omnidirectional fulcrum to permit rotational and translational pivoting movement of the elongate member.

The support arm of the elongate member may be located at a portion of the elongate member, when the elongate member is generally verticaly aligned intermediate respective upper and lower (opposite) ends thereof, or alternatively the support arm may be located in the vicinity of the upper end of the elongate member.

As used herein, the term "areal contact" as used in reference to the base surface of the omnidirectional fulcrum means that the bearing surface of the fulcrum which is reposable on a support surface, affords contact over an extended area of the support surface, as opposed to point-contact therewith.

In various embodiments, the functional element may be mounted in the vicinity of the upper end of a generally vertically aligned elongate member, and may for example include beverage container holder means, or other receptacle attachment or mounting means, or a lamp assembly or other illumination source means.

In a preferred embodiment of the invention, the functional element is a beverage container which is mounted in the vicinity of the upper end of an elongate member. The elongate member in this embodiment is joined at an upper end thereof to a laterally extending support arm.

In such preferred container holder embodiment, a counterweight is suitably attached to the lower portion of the elongate member, and the laterally extending support arm has a friction, e.g., suction, cup, or other omnidirectional fulcrum means, coupled to it such that the laterally extending support arm joined to the elongate member is pivotally balanced on the omnidirectional fulcrum means, with the fulcrum means being reposable on an edge surface of a table or similar article of furniture so that the elongate member is pivotally rotatable and translatable.

This beverage container holder is particularly advantageous when reposed on an arm top surface of an arm chair, since it accommodates the movement of the arm incident to rocking or other translation of the chair in use, as well as movement of the chair from place to place.

Other aspects and features of the invention will be more fully apparent from the ensuing disclosure and appended claims.

DETAILED DESCRIPTION OF THE INVENTION, AND PREFERRED EMBODIMENTS THEREOF

The present invention is based on the discovery that a rotationally and translationally pivotable elongate member may be employed, having a counter-weight and a pivot structure as hereinafter more fully described, as a means for mounting of a wide variety of functional elements, in an assembly wherein the pivot structure provides a means for accommodating the assembly to a support surface in a manner which occupies only a very small areal extent of the support surface.

The functional elements which may be mounted on the elongate member include lamps, light fixtures, and other illumination source means, beverage receptacle holders, magazine racks, snack trays, ashtrays, pencil holders, and receptacles for any of a wide variety of items such as candy, cigarettes, paint brushes, drafting instruments, etc.

Figure 1:
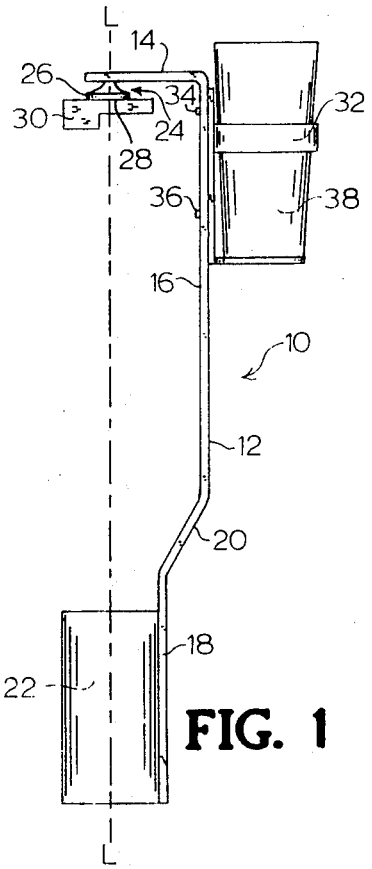
FIG. 1 is a frontal elevation view of a beverage container holder according to one embodiment of the present invention.

With reference to FIG. 1, there is shown a front elevation view of a liquid container holder according to one embodiment of the present invention.

The liquid container holder assembly 10 which includes an elongate member 12. The elongate member may be formed of any suitable material of construction, such as for example wood, metal, plastic, and the like, having the requisite rigidity and structural integrity for its intended purpose. In the embodiment shown, the elongate member may, by way of illustration, be formed of aluminum bar stock, ¼ inch thick and 1 inch in width, bent into the shape shown.

The elongate member 12 as illustrated is integrally joined at its upper portion to the laterally extending support arm 14. The elongate member 12 comprises a longitudinally extending upper portion 16 joined to a longitudinally extending lower portion 18 by an intermediate diagonally extending intermediate portion 20, as shown. The diagonally extending intermediate portion is employed solely for aesthetic purposes and is not an essential element or feature of the elongate member. It will be recognized that the elongate member may be otherwise adapted to a wide variety of shapes and configurations depending on the specific end usage thereof, with appropriate sizing of the counter-weight mounted thereon.

Mounted on the lower portion of the elongate member 18 is a counter-weight 22. Although he counter-weight illustratively shown is of generally cylindrical shape, the counter-weight may be provided in any of a wide variety of shapes and sizes, depending on the weight and configurational characteristics of the overall balancing assembly. Further, the counter-weight may be secured to the elongate member on the lower portion thereof, in spaced relationship to the bottom end of the elongate member, but it is generally preferred in practice to position the counter-weight in the vicinity of the bottom end of the elongate member.

At the upper portion of the balancing assembly, the laterally extending support arm 14 is integrally formed with and joined to the upper end of the elongate member. The support arm has joined to its undersurface, in the vicinity of its lateral extremity, an omnidirectional fulcrum 26.

There is thus provided a pivot structure 24 comprising the support arm 14 and the omnidirectional fulcrum 26. The omnidirectional fulcrum 26 has a base surface 28 which is reposable on a support surface 30, such as the generally planar arm top surface of an arm of a lawn chair, an edge portion of a table, or other structure affording a surface for reposing of the balanced assembly. By "omnidirectional fulcrum" is meant a structure which accommodates movement of the elongate member which is coupled thereto, in a rotational and/or translational mode.

The pivot structure in the embodiment shown in FIG. 1 may suitably comprise a conventional type friction, e.g., suction, cup formed of rubber or of other flexible material, which is joined at its upper end to the undersurface of the laterally extending support arm 14 with its base surface 28 in areal contact with the support surface 30, to frictionally retain the balanced assembly in pivotable position on the support surface.

Attached to the upper portion 16 of the elongate member 12, in the vicinity of the upper end thereof, is a beverage container holder 32 which is secured to the elongate member by mechanical fasteners 34 and 36, which may comprise, for example, screws, rivets, or the like. Alternatively, the beverage container holder may be integrally formed with or otherwise secured to the elongate member, e.g., by adhesive bonding, welding, or any other suitable joining means or method, appropriate to the materials of construction and the configurations of the respective elongate member and holder elements. For example, the beverage container holder may be an integral part of a unitarily molded holder/elongate member/support arm article.

In the FIG. 1 drawing, the dashed line L—L represents the centerline (center of gravity axis) of the balancing assembly. In this embodiment, the beverage container holder 32 contains a drinking glass 38, which is empty of liquid contents.

Figure 2:
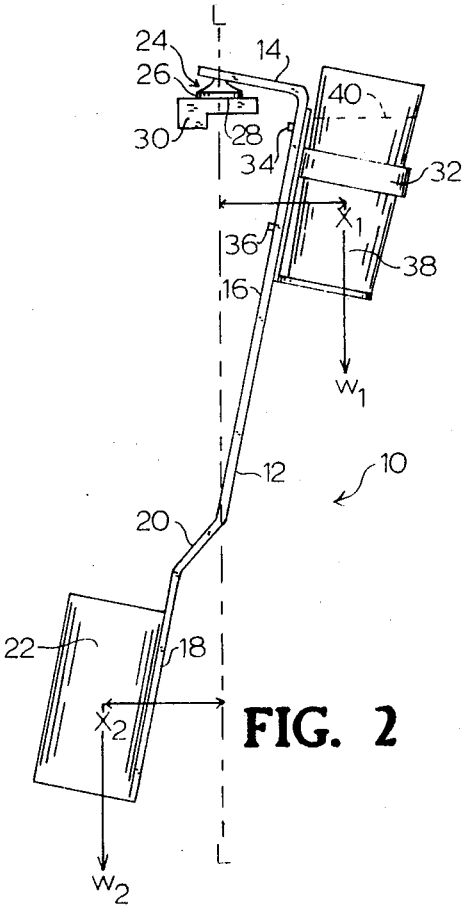
FIG. 2 is a front elevation view of the beverage container holder of FIG. 1, as laterally displaced from its normal upright position shown in FIG. 1, and including a liquid-filled beverage container mounted in the holder.

FIG. 2 is a front elevation view of the FIG. 1 balancing assembly, wherein all parts and elements are correspondingly numbered with respect to FIG. 1, but wherein the drinking glass 38 has been filled with liquid, to a depth indicated by the dashed line 40. As a result of the addition of liquid to the drinking glass 38, the balancing assembly is caused to pivotally translate about the center of gravity axis L—L as shown, so that the "lever arm" dimension $x_1$ of the upper part of the balancing assembly is related to the lever arm dimension $x_2$ for the lower part of the balancing assembly, by the expression $w_1 \cdot x_1 = w_2 \cdot x_2$, wherein the upper part lever arm dimension $x_1$ is measured from the centerline L—L to the center of gravity of the upper part of the balancing assembly, and the lower part lever arm dimension $x_2$ is measured from the centerline L—L to the center of gravity of the lower part of the balancing assembly, $w_1$ is the weight of the upper part comprising the container/liquid/container holder combination, and $w_2$ is the weight of the lower part comprising counter-weight 22.

Thus, it is seen that the balancing assembly shown in FIGS. 1 and 2 may readily accommodate a wide variety of liquid loadings in the beverage container held by the beverage container holder, without spilling of liquid. This drink holder balancing assembly may thus be deployed on the arm of a rocking chair or lawn chair, or the edge of a counter top, coffee table, card table, night stand, or other furniture article, without the danger of water-spotting of the surface on which the balancing assembly is reposed, and without the danger of surface damage to the furniture article such as is occasioned by the use of prior art clamped structures. Further, the construction of the balancing assembly positions the beverage container below the support surface, which minimizes the incidence of accidental overturning or spilling of the balance container. An additional advantage is that the entire holder assembly may readily be moved from place to place because it is not fastened to the support surface.

Figure 3:
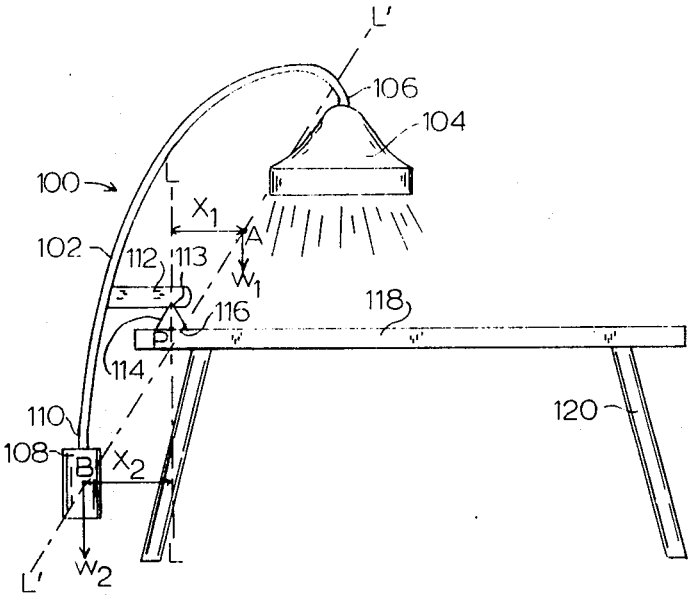
FIG. 3 is a front elevation view of a rotationally and translationally pivotable lamp assembly according to another embodiment of the present invention.

FIG. 3 is a front elevation view of a balancing lamp assembly 100, comprising a generally vertical elongate member 102, with a light fixture subassembly 104 attached thereto at a first end 106 thereof, and a counterweight 108 joined to a second end 110 thereof.

Intermediate the respective ends 106 and 110 of the elongate member, a support arm 112 is attached to the elongate member by suitable joining means, such as welding, soldering, adhesive bonding, mechanical fastening, or the like. The support arm is operatively associated with an omnidirectional fulcrum 114, which has a base surface 116 which is reposable on the top support surface 118 of the table 120, as shown.

The omnidirectional fulcrum 114 may be operatively associated with the support arm 112 in any suitable manner, such as by mechanical fastening, bonding, or the like, provided however that the thus-associated support arm and fulcrum elements are assembled to allow free rotational and translational pivotal movement of the support arm (and attached elongate member 102) relative to the fulcrum 114.

For example, the support arm 112 may be provided with a depression or recess 113 matingly receiving the upper extermity of the conical fulcrum element. In this manner, the fulcrum element may simply be positioned on the supporting surface 118 at a desired location, and the lamp then positioned, with the recess 113 in the bottom surface of support arm 112 in engagment with upper tip portion of the fulcrum.

Although not specifically shown, the lamp subassembly 104 may be associated with a power cord (not shown) by means of which the lighting means in the lamp subassembly may be energized by plug connection to a conventional wall socket. Alternatively, the illumination means in lamp subassembly 104 may be powered by a battery means, e.g., with the battery means serving as a component part of the counter-weight 108. In other words, the counter-weight may include a housing in which a battery or other self-contained power supply means may be disposed, and connected with wires extending through the elongate member 102, which for such purpose may be hollow, and joined at an opposite end of such wires to a light bulb socket or other light source means in lamp subassembly 104.

In the above-described balancing lamp assembly, not only must the relationship $w_1 \cdot x_1 = w_2 \cdot x_2$ hold, but in order to insure stability of the assembly the line L'—L' joining the respective centers of gravity, A, the center of gravity of the upper part of the assembly comprising the lamp subassembly 104, and $B_1$ the center of gravity of the lower part of the assembly comprising counterweight 108, must intersect the vertical line L—L below the pivot point P. Otherwise, the entire structural assembly could be mathematically stable, as in the case of a pencil vertically standing on its point, but nonetheless unstable as a practical matter, since any slight displacement would cause it to fall. Accordingly, the further the intersection of lines L—L and L'L' is below pivot point P, the more stable the structure will be, i.e., the more quickly it will settle into balance after being displaced.

It will be appreciated from the foregoing description that the form and character of the balancing assembly of the present invention may be widely varied, and may incorporate numerous functional elements in place of, or in addition to, the specific elements illustratively shown and described herein.

Thus, while the invention has been shown and described with reference to specific aspects, features, embodiments, it will be apparent that other variations, modifications, and embodiments are possible, and all such variations, modifications, and embodiments are therefore to be regarded as being within the spirit and scope of the invention.

What is claimed is:

1. A rotationally and translationally pivotable assembly, comprising:

an elongate member;

a functional element mounted on said elongate member;

a counter-weight mounted on said elongate member in spaced relationship to said functional element; and a single pivotal structure comprising (i) a single omnidirectional fulcrum with a base structure reposable on a support surface for areal contact therewith, and (ii) a support arm joined to said elongate member and operatively associated with said omnidirectional fulcrum to permit rotational and translational pivoting movement of said elongate member, and wherein said functional element comprises a beverage container holder secured to an upper part of said elongate member, said elongate member having joined at said upper part thereof a laterally extending support arm, wherein the beverage container holder is secured to the upper part of the elongate member below the laterally extending support arm.

2. An assembly according to claim 1, wherein said functional element is mounted on said elongate member in the vicinity of a first end thereof, and said counterweight is mounted on said elongate member in the vicinity of a second end thereof.

3. An assembly according to claim 1, wherein said counterweight is secured to a lower portion of said elongate member, in the vicinity of a lower end thereof.

4. An assembly according to claim 1, wherein said omnidirectional fulcrum comprises a friction cup which is oriented with its contact face forming said base surface, and is joined to said laterally extending support arm.

5. An assembly according to claim 1, wherein said support arm is provided with a surface depression thereon matingly receiving an upper extremity of a conical fulcrum element.

6. A beverage container holder structure, comprising:

a generally vertically aligned elongate member joined at an upper end thereof to a laterally extending support arm;

a beverage container holder mounted on an upper portion of said elongate member;

a counter-weight mounted on a lower portion of said elongate member; and a single pivot structure comprising a single omnidirectional fulcrum with a base structure reposable on a support surface for areal contact therewith, and (ii) a lateral end segment of said laterally extending support arm being mounted on said omnidirectional fulcrum, to accommodate rotational and translational pivotable movement of said elongate member relative to a said support surface;

wherein the beverage container holder is mounted on the upper portion of the elongate member below the laterally extending support arm.

* * * * *